United States Patent [19]

Wallace et al.

[11] Patent Number: 4,552,048

[45] Date of Patent: Nov. 12, 1985

[54] AUTOMATIC TRIMMING FEATURE FOR A SLICING MACHINE

[75] Inventors: Gary L. Wallace, Jeffersontown, Ky.; Frank S. Kasper, Orland Park, Ill.

[73] Assignee: AMCA International Corporation, Hanover, N.H.

[21] Appl. No.: 495,403

[22] Filed: May 17, 1983

[51] Int. Cl.[4] ..... B26D 5/20

[52] U.S. Cl. ..... 83/23; 83/42; 83/58; 83/62; 83/72; 83/355

[58] Field of Search ..... 83/23, 37, 42, 62, 58, 83/72, 355; 318/571, 39

[56] References Cited

U.S. PATENT DOCUMENTS

| | | | |
|---|---|---|---|
| 3,105,533 | 10/1963 | Hensgen et al. | 83/72 X |
| 3,131,739 | 5/1964 | Harrington | 83/209 |
| 3,133,574 | 5/1964 | Reichel et al. | 83/67 X |
| 3,136,348 | 6/1964 | Farmer | 83/63 |
| 3,144,893 | 8/1964 | Dahms | 83/72 X |
| 3,485,277 | 12/1969 | Tsutsumi et al. | 83/66 |
| 3,789,279 | 1/1974 | Dempsey et al. | 83/72 X |
| 4,226,147 | 10/1980 | Kumzi | 83/37 |
| 4,379,416 | 4/1983 | Kuchler | 83/72 X |

*Primary Examiner*—Frank T. Yost

*Attorney, Agent, or Firm*—Burns, Doane, Swecker & Mathis

[57] ABSTRACT

The current that drives the motor for a slicing blade is continuously monitored to detect when it rises above a threshold level. This threshold level is related to the resistance to the rotation of the blade that is presented by a product being sliced. When this current rises above the threshold level, the slicing operation is momentarily interrupted. The threshold level is adjustable in accordance with the number of slices that is desired to be trimmed. While the slicing operation is interrupted, the first few irregular slices from the leading edge of the product can be carried away from the location of the slicing blade. Then slicing can resume with the first slice in the first full draft being a full slice.

19 Claims, 7 Drawing Figures

AUTOMATIC TRIMMING FEATURE FOR A SLICING MACHINE

BACKGROUND OF THE INVENTION

The present invention is concerned with slicing machines, and more particularly is directed to a novel method and apparatus for automatically trimming a certain number of slices from the leading edge of a food product.

In the slicing of food products, for example the slicing of pork bellies into bacon strips, the slicing operation is carried out in cyclic fashion wherein during each cycle a predetermined number of slices, forming a group known as a draft, are removed from the product. After one draft is sliced, the slicing operation is momentarily interrupted while this draft is carried away from the slicing blade, for example by a conveyor belt, and then the slicing of the next draft begins so that there is a discernible space between adjacent drafts. These drafts are individually classified according to the quality of the meat slices therein and sold at prices relating to their respective classification.

In certain types of food products such as pork bellies, the leading edge of the product that is presented to the slicing blade by a feeding mechanism is not squarely cut. For example, the front edge of the product might be rounded or somewhat uneven. Consequently, the first few slices that are taken from the leading edge of the product have an irregular shape and a width that is much less than that of slices taken from the center of the product, for example.

If the first few slices taken from the pork belly are included in the first draft of bacon slices, this draft will necessarily have to be downgraded, i.e., it will be less than premium quality, because of these few slices, even though the majority of the slices might be of top quality. These downgraded slices are sold at a lower price or used to make other products, such as sausage for example. On the average, about ½ pound of top quality slices in a 12 pound pork belly would be unnecessarily downgraded when the first few slices are included in a draft. Accordingly, it is a common practice in the food processing industry to trim the first 4–6 slices off the leading edge of the pork belly before beginning on the first draft. With this approach, the first slice in the first draft will be a top quality slice and therefore more of the bacon from the pork belly can be sold as higher grade bacon.

In the past, the trimming of the first few slices from the pork belly was carried out manually. Typically, an operator stationed adjacent the slicing blade of the slicing machine would observe the pork belly as it was being sliced. When the operator saw that the irregular slices had been removed from the pork belly and that full slices were about to be cut, he or she would actuate a trim button which would cause the slicing operation to be temporarily interrupted. The effect of this interruption was to allow the irregular slices that had just been trimmed from the leading edge of the pork belly to be removed from the location of the slicing blade so that they would be separated from the first draft which was to be cut after the interruption had ceased.

A limitation associated with the manual trimming approach is the fact that a slicing machine operates at a much faster rate than that at which an observer can respond. For example, a modern slicing machine, while operating at full speed, might slice a strip of bacon from the pork belly every forty milliseconds. The average human typically can not respond within such a short period of time, particularly if he or she is nearing the end of the work shift and is tired from doing the same job for 6–8 hours. Consequently, two or three good slices of bacon might be included with the irregular slices before the trim button is actuated. Conversely, if the operator tries to anticipate when the slicing of full slices will begin, actuation of the button too soon will result in a partial slice being included in the first draft, and hence that draft will be downgraded. Thus, while the manual control over the trimming of the leading slices from the pork belly has resulted in some savings in the food processing industry, it has not maximized the quantity of bacon slices from a pork belly that can be sold as top quality bacon.

A slicing machine in which the first few slices are automatically removed from the leading edge of a pork belly, rather than manually, is disclosed in U.S. Pat. No. 3,131,739. In this automatic control system, a mechanical probe is placed in the path of the pork bellies as they are being fed to the slicing blade. The probe is displaced by the leading edge of a belly as it reaches a predetermined point. This point is related to the number of slices that are to be included in each draft, and the number of slices that are to be removed from the leading edge. For example, if each draft is to include 18 slices, and the first 6 slices are to be removed from the leading edge, the probe is placed at a point where it would be actuated when the leading edge of the pork belly is a distance from the blade equal to the thickness of 12 (i.e. 18 minus 6) slices. When the probe is actuated by the leading edge, it energizes a counting mechanism which controls the operation of the slicer in accordance with the number of slices to be included in each draft. Thus, when the leading edge of the pork belly is a distance equal to the thickness of 12 slices from the slicing blade, the counting mechanism would begin to count the number of rotations of the slicing blade as the pork belly continues to advance. For the first 12 rotations, no slicing would be carried out since the pork belly has not yet reached the blade. However, on the 13th through the 18th rotation, the first 6 slices would be removed from the leading edge of the pork belly. Once the counter determines that 18 rotations of the blade have taken place, the slicing operating is momentarily interrupted to provide the usual spacing between drafts. In this case, however, the spacing which is provided is between the first few irregular slices and the first draft which is about to be sliced.

While the automatic control mechanism disclosed in the '739 patent offers advantages over the manual trimming procedure, it is also limited in its practical applications. More particularly, the '739 patent is concerned with reciprocating type slicers, in which the pork bellies are fed to the blade one at a time. Typically, these types of slicers would employ a feed mechanism having a ram that would push one belly forward into the slicer. After the slicing of the belly was completed, the ram would be retracted and a new belly would be placed in position to be fed to the blade by the ram. The mechanical probe approach is really only suited for use with reciprocating type slicers, because in these machines the probe has an opportunity to drop between adjacent bellies. If the bellies are lined up in end-to-end abutment on a conveyor that continuously feeds them to the slicing blade, as is typically done in more modern slicing machines, the mechanical probe may remain in its displaced position and never detect the leading edge of the second and subsequent pork bellies. Instead, it could merely ride on the tops of the bellies from one to the next. Thus, it would not function to trim the first few slices from the leading edge of the following pork bellies.

Typically, when the pork bellies are in end-to-end abutment in a continuous feed slicer, small gaps will appear at various points along the interface of two adjacent pork bellies because their abutting ends are not squarely cut. These gaps might provide possible sources for actuation of a probe. However, the location of these gaps will vary from interface to interface because of the irregularity of each end. Thus, a single probe would not be successful in detecting a gap at each interface. To ensure adequate detection, a number of probes would have to be located across the width of the belly. Such an approach becomes quite complex and cumbersome.

In any event, even if a probe is in alignment with the gap between bellies in a continuous feed slicer, the mechanical sensing technique is not capable of responding within the short times required by modern operations. For example, the gap at the interface between bellies might typically be equal to the width of 2–3 slices. If a slice is removed every 40 msec, the probe only has 80–120 msec to fall into the gap and then be displaced again. On a practical level, this time period is simply too short for a mechanical probe to detect a gap with a reasonable degree of reliability.

Furthermore, even if the pork bellies are spaced along the conveyor belt in a continuous feed slicer so that the mechanical probe has an adequate chance to drop between adjacent bellies, they must be spaced a distance that is greater than the difference between a number of slices in a normal draft and the number of slices to be trimmed from the leading edge, i.e., more than 12 slices in the preceding example. If this spacing is not provided, the counter might be actuated by the leading edge of the second pork belly before it has finished counting the number of slices in the final draft of the preceding pork belly. For example, if the counter is re-set by the mechanical probe after it has only counted 15 slices on the preceding draft because the following belly is too close, it will cause the slicing operation to continue for another 18 slices. This action will result in more than the required number of slices being included in the last draft of the preceding pork belly.

Thus, if the pork bellies are spaced too close to one another, the mechanical probe approach can result in significant waste from too many slices being included in a draft. Conversely, if the spacing between adjacent pork bellies is large enough for the probe to operate properly, significant delays will be encountered in the slicing operation due to the "dead time" between the slicing of pork bellies.

OBJECTS AND BRIEF STATEMENT OF THE INVENTION

Accordingly, it is an object of the present invention to provide a novel method and apparatus for automatically trimming a number of slices from the leading edge of a food product.

It is another object of the present invention to provide such trimming in a manner which does not require constant visual observation and manual control over the slicing operation.

It is a further object of the present invention to provide an automatic trimming system in which the leading edge of the food product is detected by means which is capable of sensing the leading edges of successive products even when they are in abutting engagement with one another.

In accordance with these and other objects, the novel trimming feature of the present invention utilizes the current that drives the motor for the slicing blade as the indicator of the presence of the leading edge of the pork belly or similar such food product. More particularly, the current for the slicing blade motor is continuously monitored to detect when it rises above a threshold level. This threshold level is related to the resistance to the rotation of the blade that it presented by a pork belly being sliced. Thus, when no slicing is taking place, the resistance to rotation of the blade is relatively low and hence a low current is needed to drive the motor. However, as soon as the leading edge of the pork belly enters the slicing plane, the resistance to the blade will increase, causing the motor to draw a larger current. When this current rises above the threshold level, a determination is made that the leading edge of the pork belly is being sliced, and the slicing operation is momentarily interrupted. The threshold level is adjustable to initiate the interruption in accordance with the number of slices that are to be trimmed from the leading edge of the pork belly. While the slicing operation is interrupted, the first few irregular slices that have been trimmed can be carried away from the location of the slicing blade. Then slicing can resume with the first slice in the first full draft from the pork belly being a regular slice so that the draft can be graded on a higher level.

Further features and advantages of the invention are set forth in the following detailed description of a preferred embodiment of the invention illustrated in the accompanying drawings.

DESCRIPTION OF THE PREFERRED EMBODIMENT

In the following description of the preferred embodiment of the invention, particular reference is made to the slicing of pork bellies to provide a practical illustration of the problem to which the present invention is directed and the advantages which it offers. However, it will be appreciated by those having familiarity with the slicing art that the invention is not limited to this particular application but rather has a broader range of usefulness in practically any situation in which it is desired to trim the leading edge of a product before removing slices that will be used in a commercial package.

Figure 1:
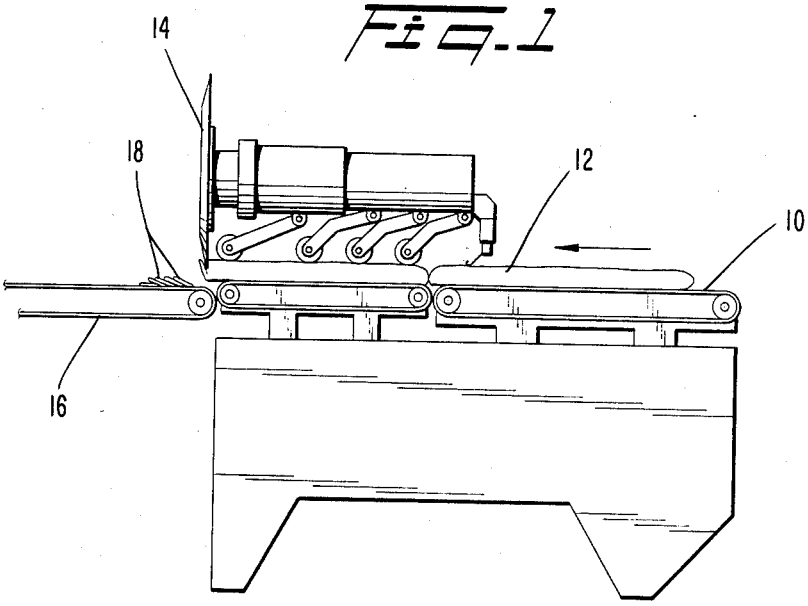
FIG. 1 is a side view in elevation of a slicing machine of the type to which the present invention is applicable.
Figure 2:
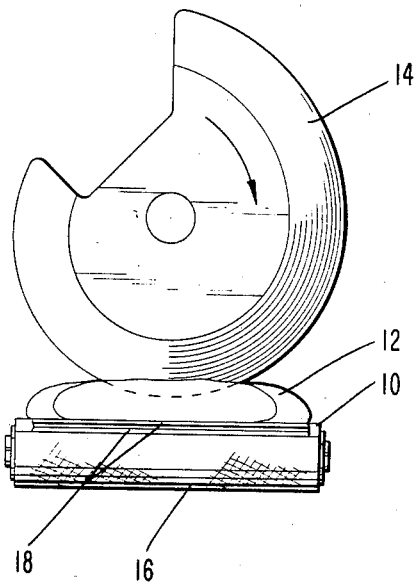
FIG. 2 is a front view of the slicing machine.

Referring to FIGS. 1 and 2, a conventional slicing machine that is typically used for slicing bacon and other similar types of food products is shown in simplified form. The slicing machine essentially comprises a conveyor belt 10 that feeds the pork bellies 12 to a continuously rotated slicing blade 14. As an alternative to a conveyor belt, other conventional feeding mechanisms, such as a pusher ram or rollers, can be employed. A second conveyor belt 16 is disposed downstream of the feed belt 10 and removes the bacon slices 18 from the location of the slicing blade.

As best illustrated in FIG. 2, the slicing blade 14 has an involute shape, i.e., its radius increases in the circumferential direction. This blade is continuously rotated, and during the slicing of a draft the feed belt 10 continuously feeds a pork belly 12 into the blade. The continuous feeding of the pork belly combined with the involute shape of the blade results in slices of relatively uniform thickness being removed from the pork belly. These slices are deposited on the conveyor belt 16 in an overlapping, or "shingled", arrangement. Because of their uniformity, the weight of each slice is known within certain limits, and hence a determination can be made that a predetermined number of slices will produce a draft of a given weight. For example, 16 slices from a pork belly might produce a one pound package of bacon. The revolutions of the slicing blade are counted and after the number of slices necessary to produce a full draft have been removed, the feed conveyor 10 is momentarily interrupted while the product conveyor 16 continues to move. Thus, a space is provided on the conveyor between the end of one draft of slices and the beginning of the next draft that is produced when the operation of the feed conveyor 10 resumes.

Alternatively, the actual weight of the slices, rather than their number, can be used to control the operation of the feed conveyor 10. In this case, the draft being produced is weighed by conventional means (not shown) and the conveyor 10 is temporarily stopped when this weight reaches a desired limit.

Figure 3:
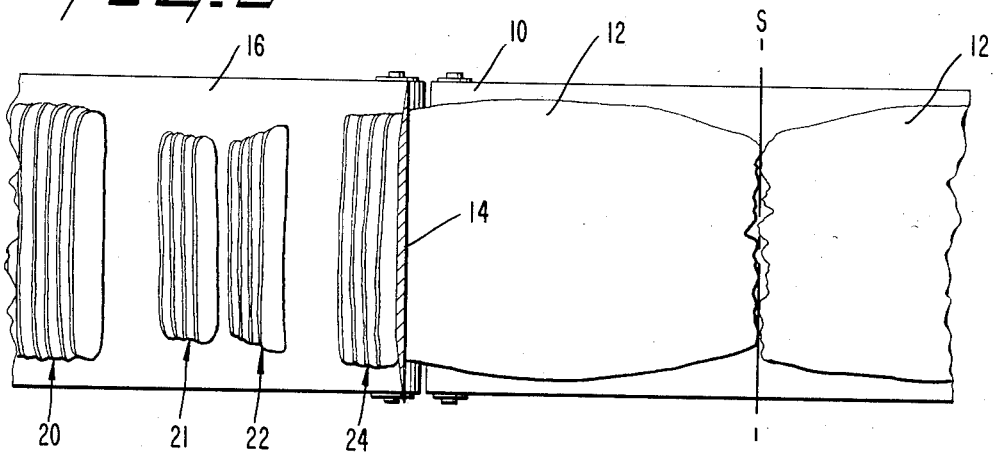
FIG. 3 is a top plan view of the slicing machine with some of the components removed to better illustrate the trimming concept to which the present invention is directed.

An example of the spacing that is provided on the product conveyor 16 is illustrated in FIG. 3. The final full draft 20 of slices from a belly is separated from the last few slices 21 from that same belly, due to the operation of the slice counting or product weighing mechanism. This draft is graded by an operator positioned along the belt 16 downstream from the slicing machine. The last few slices 21 from the belly are slightly spaced ahead of the first few slices 22 from the leading edge of the next belly.

In actual practice in a continuous feed slicer, the bellies are laid on the feed conveyor 10 in abutting engagement. However, during slicing the blade 14 has a tendency to pull the belly forward, i.e. from right to left as viewed in FIG. 3. This pull is due to the fact that the blade is somewhat dish-shaped. Consequently, as the slicing operation approaches the trailing edge of the belly, the small remaining portion of the belly offers little resistance to this force and the end of the belly being cut is pulled away from the leading edge of the following belly. This separation of the two bellies on the feed conveyor 10 results in the slight spacing of the two groups of slices 21 and 22 on the product conveyor 16. These two groups of slices are typically graded together as low quality bacon.

In the next operation, the slices 24 in the first full draft from the belly being cut are spaced from the first few slices 22 that were trimmed. This spacing is a result of the intermittent operation of the feed conveyor 10 provided by the automatic trimming feature of the invention.

As also illustrated in FIG. 3, the leading edge of the next successive pork belly is not square. Consequently, the first few, e.g. 3–6, slices that are removed from the pork belly will be quite irregular in shape and size. As noted previously, if these slices are included in a full draft that draft would have to be downgraded. However, by trimming these slices from the leading edge and separating them from the first full draft, as illustrated with respect to the slices 22 on the conveyor belt 16, the first full draft from the pork belly will contain only high quality slices and thus wastage will be reduced.

Figure 4:
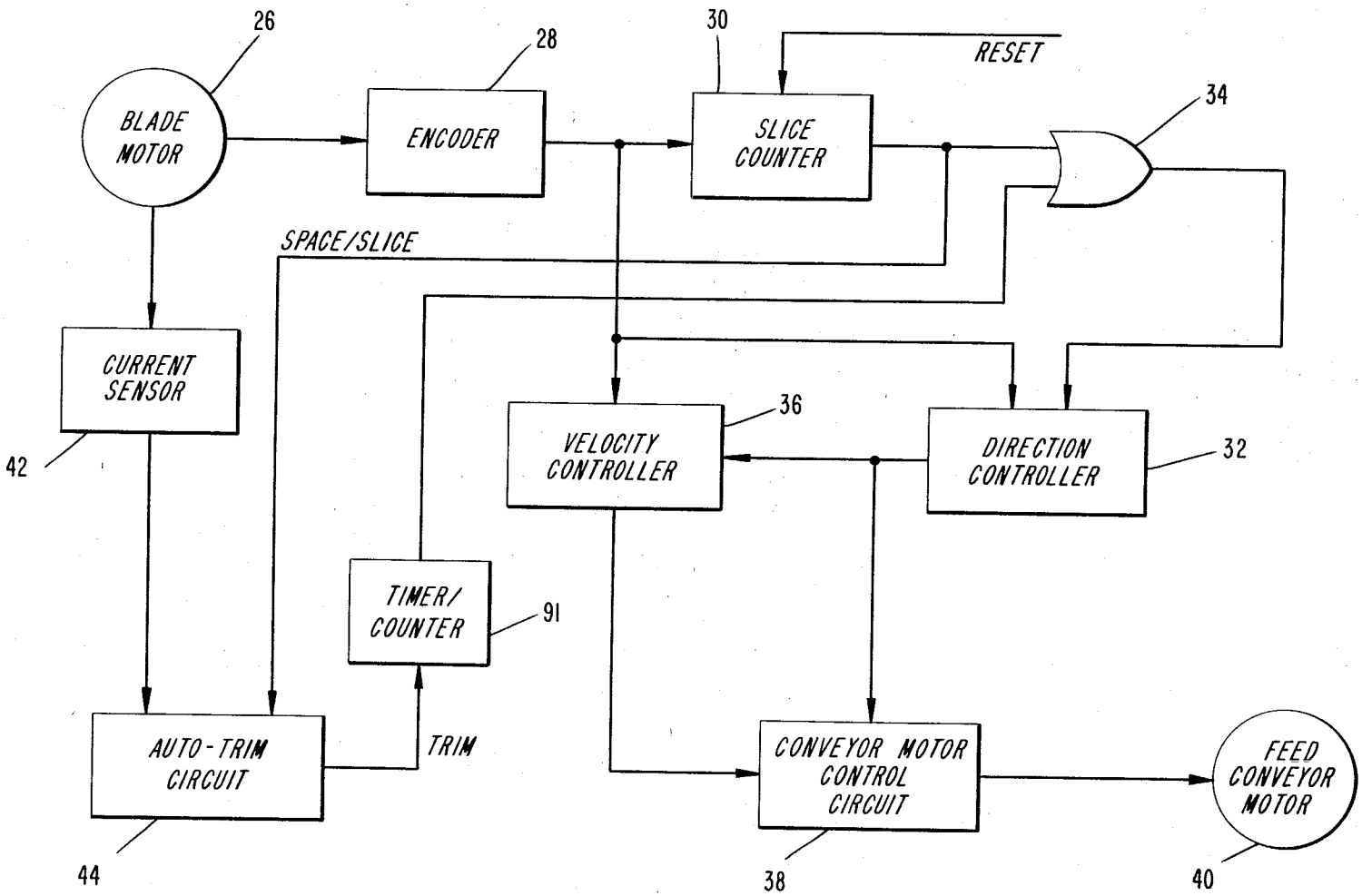
FIG. 4 is a block electrical diagram illustrating the control circuits for the feed conveyor motor of a slicing machine incorporating the automatic trimming feature of the present invention.

Turning now to FIG. 4, one circuit for controlling the feed conveyor 10 to produce the required spacing between successive drafts and for automatically trimming the leading edge of a pork belly is illustrated in block diagram form. The rotation of a motor 26 which drives the slicing blade 14 is detected by an encoder 28. The encoder produces a pulse for every revolution of the slicing blade, and these pulses are counted in a slice counter 30. The slice counter produces an output signal when the slicing blade has rotated a number of times equal to the number of slices to be included in a draft. This output signal is furnished to a direction controlling circuit 32 by means of an OR gate 34. The encoder 28 also produces a pulse for each portion of a revolution of the blade, for example one pulse for each degree of revolution. These pulses are fed to a direction controlling circuit 32 and a velocity controlling circuit 36. Control signals from these two latter circuits are provided to a motor control circuit 38 which drives a motor 40 for the feed conveyor 10.

In response to the output signal from the slice counter 30 indicating the last slice in a draft has been sliced, the feed conveyor 10 is stopped so that no further slices are produced. More preferably, as disclosed in detail in commonly assigned U.S. Pat. No. 4,226,147, the direction controller 32 and velocity controller 36 cause the feed conveyor motor 40 to rapidly withdraw the pork belly a short distance from the slicing blade. This action prevents non-uniform, i.e., wedge-shaped, slices from being cut from the front end of the now-stationary pork belly.

Subsequently, after a period of time sufficient to provide adequate spacing between drafts on the product conveyor 16, the slice counter 30 is re-set, either manually or automatically, to remove the output signal supplied to the direction controller 32. When the signal is removed, the direction controller 32 and the velocity controller 36 cause the feed conveyor motor 40 to advance the pork belly 12 towards the slicing blade 14 at a relatively fast speed until it is properly positioned to produce the first slice, at which time the velocity of the conveyor 12 is reduced and it continues to feed the pork bellies into the slicing blade at a rate determined to produce slices of a desired thickness.

Further details relating to the portion of the circuit illustrated in FIG. 4 that has been described thus far are disclosed in the above-mentioned U.S. Pat. No. 4,226,147, which is herein incorporated by reference thereto. Of course, it will be appreciated by those having familiarity with this technology that the invention is applicable to slicing machines which do not include velocity and direction controlling circuits. For example, the motor can be directly responsive to the output signal from the slice counter, being actuated or deactuated in response to the signal's absence or presence, respectively.

In accordance with the present invention, the driving current for the slicing blade motor 26 is monitored by a current sensing device 42. When the current sensing device detects that the amplitude of the current has exceeded a threshold value, a signal is sent to an automatic trimming circuit 44. This circuit produces a control signal that is fed to the feed conveyor motor control circuit, through the OR gate 34, to temporarily interrupt the feeding of the pork bellies to the slicing blade after a predetermined number of slices have been trimmed.

Figure 5:
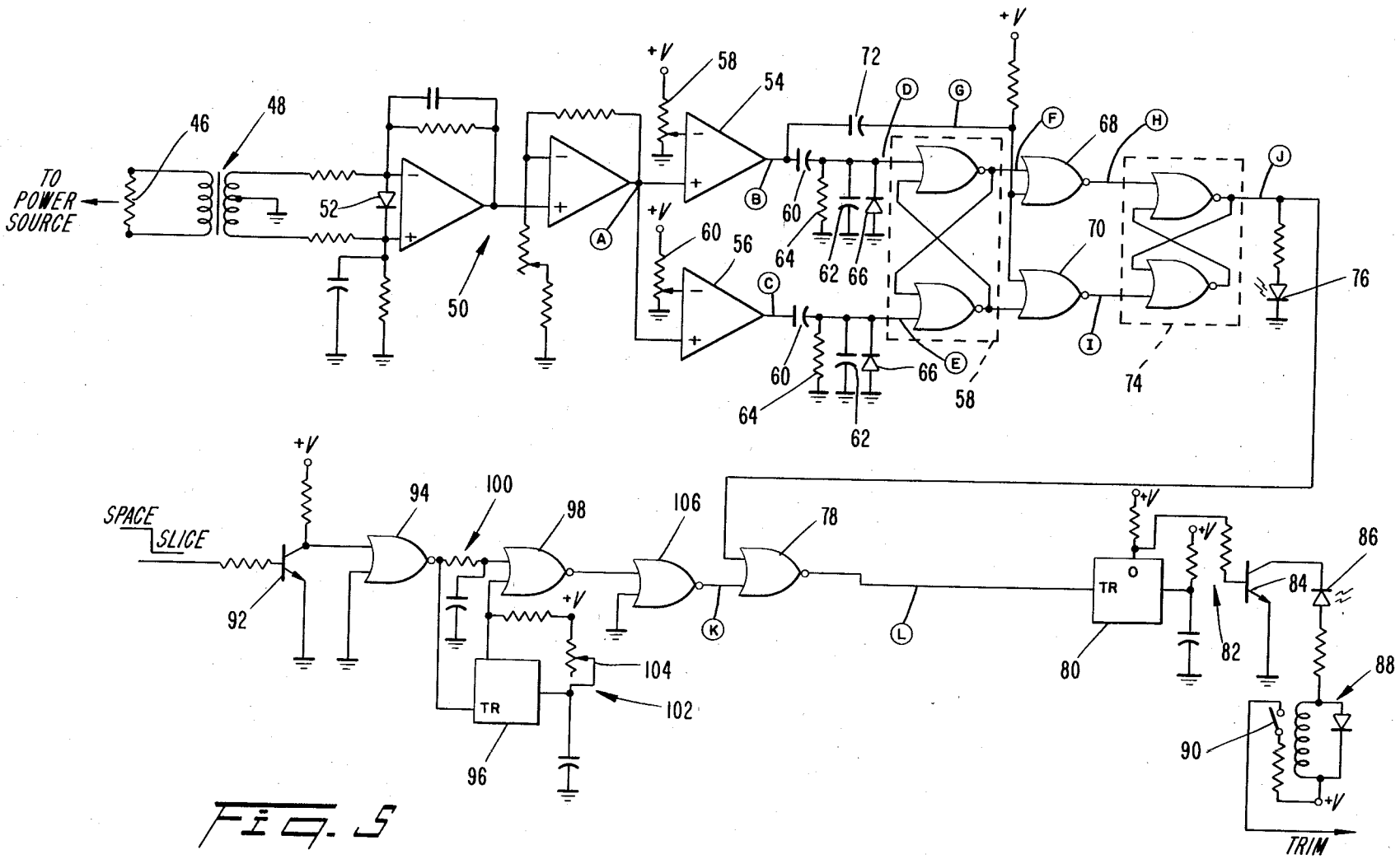
FIG. 5 is a schematic electrical diagram of the auto-trimming circuit.

The current sensing and auto-trim circuits 42 and 44 are illustrated in greater detail in FIG. 5. The slicing blade motor 26 might be driven, for example, by a single phase variable frequency power source (not shown) whose output signal is converred into a three-phase signal and supplied to the motor. Referring to FIG. 5, a current shunt 46, e.g., a resistor, is connected in parallel with the single phase output terminals of the power source. The current shunt is connected to the primary winding of an isolation transformer 48. The secondary winding of the transformer has a grounded center tap and its output terminals are connected to the input terminals of a dual-stage differential amplifier 50. A diode 52 connected across the input terminals of the amplifier provides half-wave rectification of the input signal. The output signal from the dual-stage amplifier, which comprises a half-wave rectified a.c. signal, is fed to the non-inverting input terminals of two level selection amplifiers 54 and 56. The inverting input terminals of the level selection amplifiers are connected to voltage sources through variable resistors 58 and 60, respectively. The variable resistor 58 is set so that the level selection amplifier 54 will produce a positive output signal when the half-wave rectified signal from the differential amplifiers is at a relatively low level, for example one volt. The variable resistor 60 is set at a higher level so that an output signal will be produced by the level selection amplifier 56 only when the half-wave rectified signal exceeds this higher level. For example, the higher level can be in the neighborhood of 10 volts, depending, of course, on the values of the components that form the transmission path for the current-related signal from the power source to the level selection amplifiers.

The output signals from the level selection amplifiers 54 and 56 are respectively provided to the set and re-set input terminals of a flip-flop 58 through differentiating circuits. Each differentiating circuit comprises an in-line series capacitor 60, a shunt capacitor 62 which functions as a noise filter, a shunt resistor 64 which provides a discharge path for the capacitors, and a shunt diode 66 which clamps any negative signals to ground. The flip-flop 58 is set by output pulses from the level selection amplifier 54 and re-set by output pulses from the amplifier 56.

The false and true output terminals of the flip-flop 58 are respectively connected to two NOR gates 68 and 70 that function as sample gates. The output signal from the level selection amplifier 54 is supplied to the other input terminal of the sample gates 68 and 70 through a series capacitor 72. The output terminals of the sample gates are respectively connected to the input terminals of a storage flip-flop 74, and the output terminal of this flip-flop is connected to an indicator LED 76 to provide a signal when the monitored current from the drive motor exceeds a threshold value.

Figure 6:
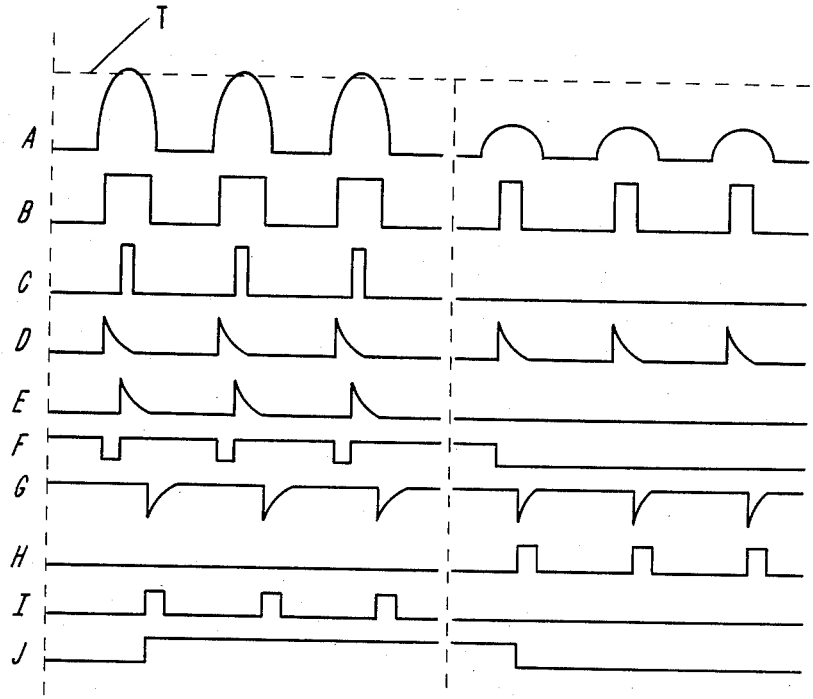
FIG. 6 is a timing diagram illustrating the relationship of signals produced in the current sensing portion of the circuit of FIG. 5.

The operation of the current sensing circuit described thus far will be explained with reference to the timing diagram of FIG. 6. The current shunt 46 produces an a.c. voltage that is amplified and half-wave rectified by the dual-stage amplifier 50 to produce the output signal A. The two level sensing amplifiers 54 and 56 respectively produce output pulses B and C each having a duration equal to that portion of the width of each half-wave which exceeds the reference voltages set by the potentiometers 58 and 60. Basically, the lower level selection amplifier 54 detects that there is a signal present, and the higher level selection amplifier 56 detects whether or not the current driving the slicing blade motor exceeds a threshold level. When the amplitude of the current exceeds the threshold level T, both of the amplifiers 54 and 56 will produce output pulses, as illustrated on the left hand portion of FIG. 6. However, when the current is below the threshold level, only the amplifier 54 will produce output pulses, as illustrated in the right hand portion of FIG. 6.

The pulse signals B and C are differentiated to provide spike signals D and E which respectively set and re-set the flip-flop 58. Thus, when the current exceeds the threshold, the flip-flop 58 will be set by a positive spike in the signal D and then re-set by a positive spike from the signal E shortly thereafter, as illustrated by the signal F. However, if the current does not exceed the threshold level, the flip-flop will be set by the signal D and remain in the set state since there is no spike in the signal E to re-set it.

The trailing edge of each pulse from the level selection amplifier 54 (signal B) is used to determine when the output signal from the flip-flop 58 is sampled by the sampling gates 68 and 70. As illustrated by signal G, each trailing edge of the pulses produce a negative-going spike that is sent as a sample signal to the sampling gates 68 and 70. The NOR gates 68 and 70 will produce a high output signal when the signals at both of their input terminals are in the low state. At all other times, i.e., when at least one of the input signals to each NOR gate is at high state, the output signal from the NOR gates will be in the low state. Thus, when the negative-going spike in the signal G is presented to each of the NOR gates 68 and 70, the gate which is receiving a low input signal from the flip-flop 58 will produce a high output signal. If, at the time the sampling pulse is produced, the true output terminal of the flip-flop 58 (signal $\overline{F}$) is in a low state, due to the current being high enough to trigger the higher level selection amplifier 56, the NOR gate 70 will produce an output pulse (signal I). However, if the current did not exceed the threshold level, the true output terminal of the flip-flop 58 will be high and the false output terminal will be low (signal F). Consequently, when the sample pulse is presented to the sample gates, the NOR gate 68 will produce a pulse (signal H), as illustrated in the right hand portion of FIG. 6. The pulses from the sample gates 70 and 68 serve to respectively set and re-set the storage flip-flop 74. Thus, if the current exceeds the threshold level, the output signal J from this flip-flop will be high, causing the indicator LED 76 to be actuated. Otherwise, the output signal will be low and the indicator light will remain off.

This indicator light can be used by an operator to adjust the setting of the potentiometer 60 to thereby set the threshold level for the current to determine when the automatic trimming function is initiated. When the slicing blade is rotating, but not cutting through a pork belly, it encounters very little resistance. Referring to FIG. 3, for example, even when two pork bellies are in abutting engagement the blade will encounter very little resistance when it is positioned at the interface S between them. Therefore, the drive motor 26 draws a relatively low current. However, as the pork belly is fed to the slicing blade, the resistance to rotation of the blade increases and so the motor 26 draws a higher current. Through observation of the LED 76 while a pork belly is being sliced, an operator can adjust the setting of the potentiometer 60 so that the flip-flop 74 produces an output signal when the slicing blade begins to slice through a portion of the pork belly that has a certain cross-sectional area.

In other words, as each successive slice is removed from the leading edge of the pork belly, the cross-sectional area of the belly through which the blade must cut increases. With increasing cross-sectional area the blade meets greater resistance, and hence draws a greater current. Through appropriate adjustment of the potentiometer 60, the threshold level can be set so the flip-flop 79 produces an output signal when the blade is cutting through an area of the belly at which it is appropriate to begin the first slice of a full draft.

This output signal from the flip-flop 74 is used to generate a TRIM control signal that is fed to the feed conveyor control circuit. To this end, the output signal from the flip-flop 74 is fed through a NOR gate 78 to provide a trigger signal to a timer 80. Upon receipt of this trigger signal, the timer 80 produces a high level output signal which is fed to a switching transistor 84 to render it conducting. Conduction of the transistor 84 energizes an LED 86 and a relay 88. Closure of the contacts 90 of the relay 88 sends a high level TRIM signal which is used to momentarily interrupt the feeding of the pork belly to the slicing blade. For example, referring to FIG. 4, the trim signal can be supplied to a timer or counter 91. This circuit produces a space signal for a predetermined time period, or a certain number of revolutions of the blade. This space signal is supplied to the direction controlling circuit 32 through the OR gate 34 to serve the same function as the last slice signal from the slice counter 30. In other words, upon receipt of this signal, the direction controller 32 will stop the feeding of the pork belly to the slicing blade.

It will be appreciated that the current drawn by the slicing blade motor 26 will drop at the end of each draft and then rise again as the slicing of each new draft begins, in addition to rising at the beginning of each pork belly. Hence, it is necessary to control the auto-trimming circuit so that the TRIM signal is provided to the feed conveyor control circuit only when the slicing machine is being commanded to carry out a slicing operation and not when it is in an intermediate, or spacing mode for separating successive drafts. In this regard, a binary level control signal is typically used to provide space and slice control signals. For example, this signal can be derived from the slice counter output signal, as illustrated in FIG. 4. A high level signal may indicate that the machine is in a standby, or spacing mode, and a low level signal will indicate that it is in a slicing mode. This signal can be used as a control signal at the other input terminal of the NOR gate 78, so that the high level output signal from the flip-flop 74 can only provide a trigger signal to the timer 80 when the leading edge of a pork belly is presented to the blade, and not when a new draft is about to be cut.

In actual practice, it has been found that the level of the current supplied to the slicing blade drive motor 26 does not immediately rise when the slicing blade first contacts the leading edge of the pork belly. Due to the high inertia of the knife, the resistance provided by the pork belly may not induce a noticeable effect on the drive motor current until maybe three or four slices, at 1500 rpm, have been produced, for example.

Accordingly, it is desirable to delay the high-to-low transitions in the space/slice signal so that the indication for the slice state is related to the delayed current change induced by the inertia of the slicing blade. To this end, the space/slice signal is fed to a TTL compatibility circuit which can comprise, for example, a CMOS NPN transistor 92. In operation, the transistor 92 inverts the space/slice signal, so it is fed therefrom to an inverter 94 which can comprise, for example, a NOR gate having one input terminal grounded. The output signal of the inverter 94, which comprises the space/slice signal in its original form, is presented to the trigger input terminal of a timer 96 and to one input terminal of a NOR gate 98 through an RC integrator 100. The purpose of the RC integrator is to filter out short transitions in the space/slice signal that may be induced by the velocity and direction controllers, or other circuitry.

A period of time after each high-to-low transition in the space/slice signal, the timer 96 produces an output signal that is fed to the other input terminal of the NOR gate 98. This time period can be varied to simulate the delay induced by the inertia of the slicing blade, such as by varying the setting of a potentiometer 104 in an RC circuit 102. For example, this time period can be about 120–160 milliseconds to account for 3–4 revolutions of the knife at a speed of 1500 rpm. The output signal from the NOR gate 98 comprises the space/slice signal with the space portion delayed by the length of the time period established by the RC circuit 102. This signal is inverted, however, and is therefore re-inverted in an inverter 106 from which it is supplied to the NOR gate 78.

Figure 7:
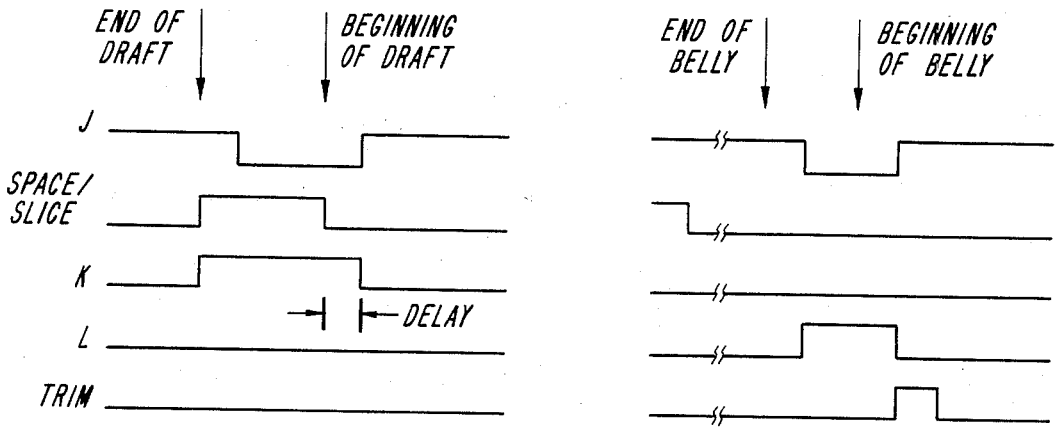
FIG. 7 is a timing diagram illustrating the relationship of signals produced in the trim control portion of the circuit of FIG. 5.

The resulting operation of the NOR gate 78 to produce the trigger pulses for the timer circuit 80 is depicted in FIG. 7. The left-hand portion of the Figure represents the normal operation that occurs between successive drafts. When the slice counter 30 indicates that the last slice in a draft has been detected, the space/slice signal goes high to put the machine in a spacing mode. Shortly thereafter, the blade motor current will drop due to the lack of resistance, and the current indicator signal J will go low. However, the high level space signal prevents the output signal L of the NOR gate 74 from going high.

Subsequently, the space/slice signal will go low to begin slicing of the next draft, and a short time later the current will rise so that the signal J goes high. As long as the delay of the slice portion of the space/slice signal (signal K) is sufficient to allow signal J to go high at the same time or before signal K goes low, the NOR gate 78 will not produce an output pulse. Consequently, the TRIM signal will not be generated for each successive draft.

Referring now to the right-hand portion of FIG. 7, the space/slice signal remains in the slice state after the last slice has been removed from the end of a belly since the counter 30 indicates that more slices are needed to complete a draft (except in the rare case where the last slice from a belly happens to be the last slice in a draft). When the current drops due to the absence of a belly at the blade, the indicator signal J will go low, causing the output L of the NOR gate 78 to go high. Subsequently, as the slicing of a new pork belly begins, the blade motor current increases and the signal J goes high. This in turn results in the NOR gate output signal L going low. The trailing edge of the pulse from the NOR gate 78 acts as the trigger signal to the timer 80.

Upon receipt of the trigger signal, the timer 80 will produce an output signal whose duration is determined by the RC circuit 82 of the timer. This output signal actuates the relay 88, which, in turn, causes the TRIM signal to be supplied to the timer/counter 91, to momentarily interrupt the feeding of the pork belly to the slicing blade. During this interruption, the product conveyor 16 continues to move, so that the slices which are trimmed from the front edge of the pork belly are carried away from the slicing blade. Thus, when slicing is resumed, these first few irregular slices will be spaced from the first full draft taken from the pork belly, rather than being included in the first draft.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A slicing machine having the capability of automatically trimming a number of slices from the leading edge of a product, comprising:

a motor driven slicing blade that is continuously actuated to provide a slicing motion;

an intermittently driven feed device for feeding a product to the slicing blade during successive cycles wherein a predetermined amount of the product is sliced in each cycle;

a continuously driven conveyor for carrying the sliced product away from the slicing blade;

means for monitoring the driving current for the slicing blade motor and detecting when the amplitude of said current exceeds a threshold value; and means responsive to said monitoring and detecting means for momentarily interrupting the feeding of the product to said slicing blade by said feed device when said threshold value is exceeded to thereby provide a spacing on said conveyor between the portion of the product that was sliced and the product that is to be sliced after said momentary interruption.

2. The slicing machine of claim 1 wherein said monitoring and detecting means includes means for detecting when said current exceeds a first level, means for detecting when said current exceeds a second level greater than said first level, and means for indicating that said current exceeds said threshold value when said first and second levels are exceeded in succession.

3. The slicing machine of claim 2 wherein said second level is adjustable.

4. The slicing machine of claim 1 including means for generating a slice/space control signal for indicating whether said machine is in a slicing mode or a standby mode, and means responsive to said control signal for inhibiting said momentary interruption unless said control signal is in a slice state indicating that said feed device is feeding the product to said slicing blade.

5. The slicing machine of claim 4 further including means for delaying the control signal fed to said inhibiting means by an amount related to the inertia of said slicing blade.

6. In a slicing machine having a motor driven slicing blade and a feed device for feeding a product to the slicing blade, a device for automatically producing visual segregation of slices from one edge of the product, comprising:

means for conveying sliced product away from the slicing blade;

means for detecting when the amplitude of the slicing blade motor current increases beyond a threshold level; and means for interrupting the slicing of the product in response to detection of the increase of current beyond said threshold level while said conveying means continues to convey the sliced product away from the blade.

7. The trimming device of claim 6 wherein said interrupting means temporarily ceases the feeding of the product to the slicing blade.

8. The trimming device of claim 6 wherein said threshold level is adjustable.

9. The trimming device of claim 6 wherein said feed device feeds plural products to the slicing blade and is operated in an intermittent manner to produce separate drafts of slices, and further including means for distinguishing spacing between two products in said feed device from spacing between successive drafts from the same product, and for inhibiting said interrupting means unless a spacing between products is detected.

10. The trimming device of claim 9 wherein said distinguishing means is responsive to a signal indicating whether said device is in a slicing mode or in a spacing mode.

11. The trimming device of claim 10 further including means for delaying said signal by an amount related to the inertia of said slicing blade.

12. In a slicing machine in which a product is fed to a motor driven slicing blade and sliced product is conveyed away from the blade, a method for visually segregating irregular slices from the leading edge of the product, comprising the steps of:

monitoring the slicing blade motor current;

detecting when the amplitude of said current exceeds a threshold value; and interrupting the slicing of the product in response to the current exceeding the threshold value while continuing to convey sliced product away from the slicing blade.

13. The method of claim 12 further including the step of resuming the slicing of the product at the end of a predetermined time delay after said interruption begins.

14. The method of claim 12 wherein said detecting step includes determining whether said current exceeds each of a first and a second amplitude level in succession, said second level being greater than said first level, and indicating that said threshold value is exceeded when said second level is exceeded.

15. The method of claim 12 further including the steps of generating a control signal to indicate whether the slicing machine is in a slicing or standby mode, and inhibiting the interruption of slicing in response to said detection unless said control signal indicates the slicing mode.

16. The method of claim 15 further including the step of delaying said control signal by an amount related to the inertia of the slicing blade.

17. The method of claim 12 wherein said interrupting step comprises temporarily halting the feeding of the product to the slicing blade.

18. A method for automatically segregating different classes of a food product during the slicing thereof, comprising the steps of:

feeding the food product into a slicing blade to thereby cut slices from the product;

conveying the slices away from the slicing blade;

monitoring variations in a signal related to the cross-sectional area of the product being sliced;

detecting when the signal crosses a threshold level; and momentarily interrupting the feeding of the product when the signal crosses the threshold level while continuing to convey the slices away from the knife so that slices which are cut after the momentary interruption are visibly separate from slices cut before the interruption.

19. The method of claim 18 wherein said monitoring step comprising monitoring the amplitude of current supplied to a motor which drives the slicing blade.

* * * * *